United States Patent [19]

Wixon

[11] 3,951,879

[45] Apr. 20, 1976

[54] DETERGENT THAT REDUCES ELECTROSTATIC CLING OF SYNTHETIC FABRICS

[75] Inventor: Harold Eugene Wixon, New Brunswick, N.J.

[73] Assignee: Colgate-Palmolive Company, New York, N.Y.

[22] Filed: Dec. 14, 1973

[21] Appl. No.: 424,903

[52] U.S. Cl. ..... 252/547; 8/137; 252/8.8; 252/528

[51] Int. Cl.[2] ..... C11D 1/00; C11D 1/02; C11D 1/62; C11D 1/66

[58] Field of Search ..... 252/547, 528, 8.75, 252/8.8; 8/137

[56] References Cited

UNITED STATES PATENTS

| | | | |
|---|---|---|---|
| 2,908,651 | 10/1959 | Grifo | 252/153 |
| 3,320,174 | 5/1967 | Rubinfeld | 252/542 X |
| 3,597,416 | 8/1971 | Diehl | 252/547 X |
| 3,681,241 | 8/1972 | Rudy | 252/8.75 |
| 3,686,098 | 8/1972 | Weil | 250/550 |
| 3,856,684 | 12/1974 | Atkinson | 252/8.8 |

*Primary Examiner*—Thomas J. Herbert, Jr.
*Attorney, Agent, or Firm*—Norman Blumenkopf; Herbert S. Sylvester; Murray M. Grill

[57] ABSTRACT

A laundry detergent which simultaneously cleans and substantially reduces the static-cling on synthetic fabrics comprising essentially an organic detergent, a maximum of 1% quaternary ammonium compound and 0.5–1.0% of a water soluble inorganic or organic calcium or magnesium salt by weight of the total formulation.

8 Claims, No Drawings

DETERGENT THAT REDUCES ELECTROSTATIC CLING OF SYNTHETIC FABRICS

The present invention relates to a laundry product which cleans and substantially reduces static in synthetic fabrics comprising a small concentration of a quaternary softener and a small concentration of a water-soluble calcium or magnesium salt to minimize the adverse effect of said quaternary on detergency.

Efforts have been made to modify detergent compositions to impart additional properties to laundered fabrics without interfering with the cleaning efficacy thereof. With the advent of synthetic fabrics such as nylon, polyester and blends such as polyester/cotton, and anti-static properties of laundering formulations has become an essential feature thereof. Synthetic fabrics washed in commercially available detergents exhibit very strong static cling when removed from the dryer and during use, especially in cold, low humidity weather. The quaternary compounds heretofore utilized as softening agents have been found to also possess anti-static properties. However, the amount of quaternary compound necessary to yield effective anti-static properties (about 5% by weight) has been found to have an adverse effect on the overall cleaning efficacy on fabrics, most noticeable on synthetic fabrics. Reducing the amount of the quaternary compound minimizes the adverse effect on cleaning, whitening and soil redeposition, but also significantly reduces its anti-static properties on synthetic fabrics. However, it has been found that the addition of a small amount of a calcium or magnesium salt to a small amount of aforesaid quaternary unexpectedly exhibits excellent anti-static effects in a laundry product.

Consequently, it is a primary object of this invention to provide a composition for both cleaning and eliminating static on synthetic fabrics without adversely affecting its cleaning efficacy.

Other objects will appear as the description proceeds.

In accordance with the above objects, the bifunctional detergent composition of this invention comprises essentially an organic surfactant selected from the class consisting of anionic, non-ionic, amphoteric and mixtures thereof, about 0.5–1.0% magnesium or calcium salt and about 0.25–1.0% quaternary ammonium softener compound by weight of the total formulation.

It has been found that the anti-static performance is maintained at a high level and the adverse effect of the quaternary on cleaning, whitening and redeposition is minimized by using a reduced quaternary concentration in a blend with a magnesium or calcium salt.

An essential ingredient in instant formulation is the quaternary ammonium fabric softeners which are commercially known, and may be represented by the following formulae:

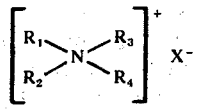

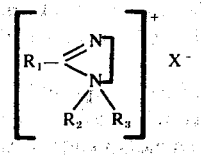

wherein $R_1$ is a long chain aliphatic radical having from 8 to 22 carbon atoms, $R_2$ is a long chained aliphatic radical having from 8 to 22 carbon atoms or is a lower alkyl radical having from 1 to 4 carbon atoms or an aryl or aralkyl radical, $R_3$ and $R_4$ are lower alkyl radicals, and X is a water soluble salt forming anion such as a halide, i.e. chloride, bromide, iodide; a sulfate, acetate, hydroxide, methosulfate or similar inorganic or organic solubilizing mono- or dibasic radical. The carbon chain of the aliphatic radical containing 8 to 22 carbon atoms may be straight or branched, and saturated or unsaturated. The lower alkyl radicals may contain a hydroxy radical. The preferred ammonium salt is a dialkyl dimethyl ammonium chloride wherein the alkyl group is derived from hydrogenated tallow or stearic acid, or a dialkyl imidazolinium chloride. Specific examples of quaternary ammonium softening agents suitable for use in the composition of the present invention include the following: hydrogenated ditallow dimethyl ammonium chloride, 1-hydroxyethyl-1 -methyl-2-heptacdecyl imidazolinium chloride, dimethyl distearyl ammonium chloride, trimethyl stearyl ammonium bromide, cetyl trimethyl ammonium chloride, di-coco dimethyl ammonium chloride, higher alkyl dimethyl benzyl ammonium chloride, di-isobutyl phenoxy ethoxyethyl dimethyl benzyl ammonium chloride, benzyl dimethyl stearyl ammonium chloride, the corresponding sulfate, methosulfate, bromide and hydroxide salts thereof, etc.

The term "coco" when utilized refers to fatty acid groups formed in coconut oil fatty acids. Such acids contain from about 8 to 18 carbon atoms per molecule predominating in the $C_{12-14}$ acid.

Suitable quaternary ammonium compounds are available as 95 percent active powders, 75 percent active aqueous alcoholic pastes and in 25–50 percent aqueous alcoholic solutions. It is preferred to use the 95 percent active powder material, but choice of particular physical form is dependent upon storage and production facilities.

The amount of quaternary ammonium compound must be sufficient to impart anti-static properties to fabrics without adversely affecting the detergency properties of a laundry product. A range of about 0.25–1.0 % by weight active quaternary compound in a detergent composition together with magnesium or calcium salt imparts significant anti-static properties to fabrics without sacrificing the cleaning properties thereof.

Another essential ingredient of instant formulation is a substantially water-soluble magnesium or calcium salt which may be either inorganic or organic, the degree of solubility being such that at least 1 gram and preferably 5 grams readily dissolves in about 17 gallons water (the usual amount of wash water utilized in washing machines) at a temperature range of 40°F to 120°F. This magnesium or calcium salt coacts synergistically with the quaternary compound in the detergent composition to effect anti-static properties to synthetic fabrics laundered herewith. The superior anti-static properties possessed by this formulation is unexpected in view of the substantially negligible anti-static effect of the quaternary when utilized in amounts less than 5% by weight of the total detergent composition. Suitable magnesium and calcium salts include the acetates, bromides, carbonates, chlorides, citrates, nitrates, phosphates, sulfates and mixtures thereof, either anhydrous or hydrated, powdered or granular. The amount of magnesium or calcium salt advantageously utilized with the minimized amount of quaternary compound is preferably about 0.5–1.0% by weight of the total detergent formulation.

Additionally, the present invention contemplates the employment of either or both of the quaternary softener and magnesium or calcium salt in admixture comprising two or more, the advisability of so proceeding depending primarily upon the requirements of the processor. In any event, this particular expedient affords to the formulator effective means whereby to capitalize on the beneficial properties characterizing each of a plurality of quaternary and/or magnesium and/or calcium salt compounds. Ratios and concentrations of ingredients may be varied to alter cleaning, whitening and anti-static performance. Other ingredients may be included in minor amounts i.e., from 0 to 5% and preferably from 0.1% to 3% by weight of composition, such ingredients including without necessary limitation, olfactory agents, optical brighteners, dyes, bluing, diluents and other additives, which do not interfere with the anti-cling and cleaning properties of this composition. Where manufacture of the anti-static detergent composition in the form of a tablet is contemplated, materials such as typified by corn starch may be added to expedite breakup of the tablet.

The process of laundering synthetic fabrics with instant anti-static detergent composition is not dependent on temperature and performs well with either cold or warm laundering solutions. Also, the process can be conducted using water of any reasonable degree of hardness, although obviously, the use of softer wash water is preferred. The pH of the wash water must be alkaline, namely, above a pH of 8 and preferably a pH of 9–10 for effective laundering of fabrics.

Another essential ingredient of instant invention is at least one organic detergent selected from the class consisting of anionic, non-ionic and amphoteric surfactants and mixtures thereof. The anionic detergents are commercially known and include those surface active compounds which contain an organic hydrophobic group and an anionic solubilizing group such as sulfonate, sulfate, carboxylate, phosphonate and phosphate. The hydrophobic group is an alkyl or aralkyl radical containing 8 to 22 carbon atoms.

As examples of suitable synthetic anionic detergents there may be cited the higher alkyl mononuclear aromatic sulfonates such as the higher alkyl benzene sulfonates containing from 10 to 16 carbon atoms in the alkyl group in a straight or branched chain, e.g., the sodium salts of higher alkyl benzene sulfonates; alkyl naphthalene sulfonate, ammonium diamyl naphthalene sulfonates, and sodium dinonyl naphthalene sulfonate. In one preferred type of composition there is used a linear alkyl benzene sulfonate having a high content of 3- (or higher) phenyl isomers and a correspondingly low content (well below 50%) of 2- (or lower) phenyl isomers; in other terminology, the benzene ring is preferably attached in large part at the 3 or higher (e.g. 4, 5, 6 or 7) position of the alkyl group and the content of isomers in which the benzene ring is attached at the 2or 1 position is correspondingly low. Particularly preferred materials are set forth in U.S. Pat. No. 3,320,174, May 16, 1967, of J. Rubinfeld.

Other anionic detergents are the olefin sulfonates, including long chain alkene sulfonates, long chain hydroxyalkanesulfonates. These olefin sulfonate detergents may be prepared, in known manner, by the reaction of $SO_2$ with long chain olefins (of 8–25, preferably 12–21 carbon atoms) of the formula $RCH = CHR_1$, where R is alkyl and $R_1$ if alkyl or hydrogen, to produce a mixture of sultones and alkenesulfonic acids, which mixture is then treated to convert the sultones to sulfonates. Examples of other sulfate or sulfonate detergents are paraffin sulfonates, such as the reaction products of alpha olefins and bisulfites (e.g. sodium bisulfite), e.g. primary paraffin sulfonates of about 10–20, preferably about 15–20, carbon atoms; sulfates of higher alcohols; salts of $\alpha$-sulfofatty esters (e.g. of about 10- to 20-carbon atoms, such as methyl $\alpha$-sulfomyristate or $\alpha$-sulfotallowate).

Examples of sulfates of higher alcohols are sodium lauryl sulfate, sodium tallow alcohol sulfate. Turkey Red Oil or other sulfated oils, or sulfates of mono- or di-glycerides of fatty acids (e.g. stearic monoglyceride mono-sulfate), alkyl poly (ethenoxy) ether sulfates such as the sulfates of the condensation products of ethylene oxide and lauryl alcohol (usually having 1 to 5 ethenoxy groups per molecule); lauryl or other higher alkyl glyceryl ether sulfonates; aromatic poly (ethenoxy) ether sulfates such as the sulfates of the condensation products of ethylene oxide and nonyl phenol (usually having 1 to 6 oxyethylene groups per molecule).

The suitable anionic detergents include also the acyl sarcosinates (e.g. sodium lauroylsarcosinate), the acyl esters (e.g. oleic acid ester) of isethionates, and the acyl N-methyl taurides (e.g. potassium N-methyl lauroyl- or oleyl tauride).

The most highly preferred water soluble anionic detergent compounds are the ammonium and substituted ammonium (such as mono-, di- and triethanolamine), alkali metal (such as sodium and potassium) and alkaline earth metal (such as calcium and magnesium) salts of the higher alkyl benzene sulfonates, olefin sulfonates, the higher alkyl sulfates, and the higher fatty acid monoglyceride sulfates. The particular salt will be suitably selected depending upon the particular formulation and the proportions therein.

Soaps, which are also anionic detergents, may be utilized in addition to the synthetic anionic detergents primarily for foam control if necessary or desirable. Suitable water-soluble salts of higher fatty acids or rosin acids include alkali metal salts of saturated, unsaturated, or mixtures of unsaturated and saturated, fatty acids containing from about 8 to about 18 carbon atoms in the molecule such as: sodium caprate, sodium laurate, sodium myristate, sodium palmitate, potassium oleate, sodium stearate, sodium and potassium salts of tallow fatty acids, sodium and potassium salts of coconut oil fatty acids, and the like.

The amount of anionic detergent may vary widely depending on the specific nature and intended use of the detergent formulation. In general, however, from about 5 to 20% synthetic anionic detergent and from about 0 to 4% soap based on the total weight of the formulation may be used. The ratio of the specific surfactants may be varied within suitable performing limits.

The nonionic surface active compounds which are contemplated are commercially known and comprise the water-soluble products which are derived from the condensation of an alkylene oxide or equivalent reactant and a reactive-hydrogen hydrophobe. The hydrophobic organic compounds may be aliphatic, aromatic or heterocyclic, although the first two classes are preferred. The preferred types of hydrophobes are higher aliphatic alcohols and alkyl phenols, although others may be used such as carboxylic acids, carboxamides, mercaptans, sulphonamides, etc. The ethylene oxide condensates with higher-alkyl phenols represent a preferred class of nonionic compounds. Usually the hydrophobic moiety should contain at least about 6 carbon atoms, and preferably at least about 8 carbon atoms, and may contain as many as about 50 carbon atoms or more. The amount of alkylene oxide will vary considerably depending upon the hydrophobe, but as a general guide and rule, at least about 5 moles of alkylene oxide per mole of hydrophobe should be used. The upper limit of alkylene oxide will vary, also, but no particular criticality can be ascribed thereto. As much as 200 or more moles of alkylene oxide per mole of hydrophobe may be employed. While ethylene oxide is the preferred and predominating oxyalkylating reagent, other lower alkylene oxides such as propylene oxide, butylene oxide, and the like may also be used or substituted in part for the ethylene oxide. Other nonionic compounds which are suitable are the polyoxyalkylene esters of the organic acids such as the higher fatty acids, the rosin acids, tall oil acids, acids from petroleum oxidation products, etc. These esters will usually contain from about 10 to about 22 carbon atoms in the acid moiety and from about 12 to about 30 moles of ethylene oxide or its equivalent.

Still other nonionic surfactants are the alkylene oxide condensates with the higher fatty acid amides. The fatty acid group will generally contain from about 8 to about 22 carbon atoms and this will be condensed with about 10 to about 50 moles of ethylene oxide as the preferred illustration. The corresponding carboxamides and sulphonamides may also be used as substantial equivalents.

Still another class of nonionic products are the oxyalkylated higher aliphatic alcohols. The fatty alcohols should contain at least 6 carbon atoms, and preferably at least about 8 carbon atoms. The most preferred alcohols are lauryl, myristyl, cetyl, stearyl and oleyl alcohols and the said alcohols should be condensed with at least about 6 moles of ethylene oxide, and preferably about 10 to 30 moles of ethylene oxide. A typical nonionic product is oleyl alcohol condensed with 15 moles of ethylene oxide. The corresponding alkyl mercaptans when condensed with ethylene oxide are also suitable in the compositions of the present invention.

The amount of non-ionic may generally be varied from about 2–20% by weight of the total formulation, depending on the amounts and nature of the other particular ingredients as well as on the intended use of said detergent.

The amphoteric surfactants are commercially known and include derivatives of aliphatic amines which contain a long chain of about 8 to 20 carbon atoms and an anionic water-solubilizing group such as carboxy, sulfo, sulfato and the like. Among these are the N-long chain alkyl aminocarboxylic acids e.g. of the formula $$R-\overset{\overset{R_2}{|}}{N}-R^1-COOM;$$

the N-long chain alkyl iminodicarboxylic acids (e.g. of the formula $RN(R^1COOM)_2$), where R is a long chain alkyl group, $R^1$ is a divalent radical joining the amino and carboxyl portions of an amino acid (e.g. an alkylene radical of 1–4 carbon atoms), M is hydrogen or a salt forming metal, $R^2$ is a hydrogen or another monovalent substituent (e.g. methyl or other lower alkyl). Examples of specific detergents are N-alkyl-beta-aminopropionic acid; N-alkyl-beta-iminodipropionic acid and N-alkyl, N-N-dimethyl glycine; the alkyl group may be, for example, the derived from coco fatty alcohol, lauryl alcohol, myristyl alcohol (or lauryl-myristyl mixture), hydrogenated tallow alcohol, cetyl, stearyl or blends of such alcohols. The substituted amino propionic and iminodipropionic acids are often supplied in the sodium or other salt forms which may likewise be used in the practice of this invention. Specific amphoterics are sodium-3-dodecylaminopropionate and sodium-3-dodecylaminopropanesulfonate.

The amount of amphoteric detergent may vary widely depending on the specific nature and intended use of the formulation as well as on the nature and amounts of the other particular ingredients. Generally, however, from about 2–20% by weight of the total formulation may be used.

Instant detergent composition may also include water soluble builder salts. Water-soluble inorganic alkaline builder salts which can be used alone with the detergent compound or in admixture with other builders are alkali metal carbonates, borates, phosphates, polyphosphates, bicarbonates and silicates. (Ammonium or substituted ammonium salts can also be used.) Specific examples of such salts are sodium tripolyphosphate, sodium carbonate, sodium tetraborate, sodium pyrophosphate, potassium pyrophosphate, sodium bicarbonate, potassium tripolyphosphate, sodium hexamethaphosphate, sodium sesquicarbonate, sodium mono- and diorthophosphate, and potassium bicarbonate.

Examples of organic alkaline sequestrant builder salts which can be used alone with the detergent or in admixture with other organic and inorganic builders are alkali metal, ammonium or substituted ammonium, aminopolycarboxylates, e.g., sodium and potassium ethylene diaminetetraacetate, sodium and potassium and triethanolammonium N-(2-hydroxyethyl)-nitrilodiacetates. Mixed salts of these polycarboxylates are also suitable.

Various adjuvants may be present in the detergent product to give it additional desired properties, either of functional or aesthetic nature. Thus, there may be included in the formulation; minor amounts of soil suspending or anti-redeposition agents, e.g., polyvinyl alcohol, sodium carboxymethyl cellulose, hydroxy-propyl methyl cellulose; optical brighteners, e.g. cotton, amine and polyester brighteners, bactericides, e.g., tetrachlorosalicylanilide, hexachlorophene; fungicides; dyes; pigments (water dispersible); preservatives; ultraviolet absorbers, color safe bleach e.g. perborate, percarbonate, etc., and perfumes. In the selections of the adjuvants, they will be chosen to be compatible with the main constituents of the detergent composition.

This laundry product is preferably prepared by simply admixing a magnesium or calcium salt and the quaternary compound with spray dried detergent, either separately or as a blend. The individual ingredients of instant laundry product may be dry blended and used as such. Similarly the magnesium or calcium salt and quaternary may be crutched and spray dried with the detergent. Instant product may also be formulated as a liquid, granular or powdered product or formed into pellets or other suitable shape.

The invention has found its greatest utility thusfar in the elimination of static on synthetic fabrics, e.g., nylon, polyethylene terephthalate, cellulose acetate, acrylonitrile polymers or copolymers, or blends of any two or more fibers (e.g., cotton-polyester blends). This anti-static cleaning composition may be applied to the fabrics in an aqueous bath during the wash cycle of laundering. About 100g of instant detergent product is added to an automatic washing machine containing 17 gallons (35 liters) of water, and an average load of fabrics (about 6 to 8 pounds). However, lesser or greater amounts may be utilized to obtain the desired degree of whiteness and anti-static properties, depending on the water temperature, the water hardness, the amount of water and clothes, etc. The washing temperature may be varied from 40°F to 160°F.

The following examples are given to further illustrate this invention. All parts given are by weight unless otherwise indicated. In the Examples, the pressure is atmospheric unless otherwise indicated.

EXAMPLE 1

| Ingredients | % |
|---|---|
| Linear Tridecyl Benzene Sulfonate (LTBS) | 8.0 |
| $C_{14-15}$ Primary Alcohol ethoxylate with ave. of 11 Ethylene Oxide Units | 1.0 |
| $C_{12-15}$ Primary Alcohol ethoxylate with ave. of 7 Ethylene Oxide Units | 4.0 |
| Sodium Tripolyphosphate (TPP) | 33.0 |
| Sodium Silicate (1:2.35) | 7.0 |
| Distearyl Dimethyl Ammonium Chloride | 0.5 |
| $CaCl_2$, anhydrous, granular, 12 mesh | 0.5 |
| Brighteners, Carboxymethyl Cellulose, $Na_2SO_4$ and Moisture | QS |
| | 100.0 |

The sulfonate, ethoxylates, tripolyphosphate, silicate, brighteners, carboxymethyl cellulose, $Na_2SO_4$ and moisture are blended and spray dried. The powdered distearyl dimethyl ammonium chloride and $CaCl_2$ are added to the spray dried detergent and blended therewith. The load, consisting of 8 lbs. of synthetic fabrics such as nylon and blends, dacron/cotton blends is subjected to machine washing in 17 gallons tap water having a water hardness of 150 ppm, at 90°F, with 100 grams of above formulation and subsequently is dryer dried and examined for static noise and cling, and whiteness (-b scale, Gardner Color Difference Meter; 0.5 unit difference visually discernible).

Comparison tests run with the composition of Example 1, with the spray dried detergent plus 1% and 2% quaternary, and with detergent plus various magnesium and calcium salts gave the following results:

TABLE I

| | Static Cling | Static Noise | Towel Whiteness −b |
|---|---|---|---|
| Composition of Ex. 1 without quat. and $CaCl_2$ | Strong | Strong | −8.4 |
| Composition of Ex. 1 | None | Very Slight | |
| 1.0% quat - no $CaCl_2$ | Strong | Strong | |
| 2.0% quat - no $CaCl_2$ | Moderate | Moderate | |
| 0.5% quat, 0.5% $CaSO_4$ | Slight | Moderate | |
| 0.5% quat, 1.0% $CaSO_4$ | None | Slight | |
| 0.5% quat, 0.5% $MgSO_4$ | Slight | Slight | −9.1 |
| 0.25% quat, 0.5% $MgSO_4$ | Slight | Moderate | |
| No quat, 0.5% $MgSO_4$ | Strong | Strong | |

It is clearly shown that detergent plus 1% quaternary alone does not decrease static and 2% quaternary has a minimal affect on static reduction, similarly, the $MgSO_4$ has no affect on static reduction. However, the presence of 0.5–1.0% magnesium or calcium salt permits the use of quaternary concentrations as low as 0.25% by weight of the total composition and still obtain good anti-static performance.

Thus, it is apparent that the use of a blend of quaternary and magnesium or calcium salt yields a totally unexpected synergistic anti-static effect, and minimizes the adverse effect of the quaternary on the cleaning capacity of the detergent as shown below.

EXAMPLE 2

The washing procedure of Example 1 was followed wherein the concentration of the aforedefined detergent in the wash water is 0.15% utilizing detergent of Example 1 and detergent without the quaternary and the $CaCl_2$, on a load consisting of 2 swatches each of Spangler particulate soiled cotton, Spangler particulate soiled dacron/cotton and clean dacron/cotton (for redeposition). Cleanness was measured on Rd scale of Gardner Gardner color meter (about 1Rd unit visually discernible).

TABLE II

| | ΔRd (Units Soil Removed or Redeposited) Cotton Detergency | Dacron/Cotton Detergency | Dacron/Cotton Redeposition |
|---|---|---|---|
| (1) Detergent of Ex. 1 | 24.3 | 8.8 | 0.9 |
| (2) Detergent without quat. and $CaCl_2$ (Control) | 25.8 | 9.9 | 0.7 |

Detergency loss is minimal since about 1Rd unit is visually discernible. Redeposition equals control.

EXAMPLE 3

Magnesium sulfate was substituted for $CaCl_2$ of Example 1. The following results were obtained after treating fabric therewith in accordance with the procedure of Example 1:

| | Static Noise | Static Cling | −b |
|---|---|---|---|
| Wash 1 | Slight | Slight | −9.1 |
| Wash 2 | Slight | Very Slight | — |
| Wash 3 | Slight | None | −10.5 |
| Wash 4 | — | — | — |
| Wash 5 | Very slight | None | −10.1 |

The beneficial performance of instant products are continuous as evidenced by enhanced whiteness and anti-static properties exhibited by fabrics after 5 washes.

EXAMPLE 4

The $MgSO_4$ of Example 3 was increased to 1%. Fabric washed with this composition and treated in accordance with the procedure of Example 1 exhibited slight static cling and noise.

EXAMPLE 5

The quaternary content of Example 3 was increased to 1%. Fabric treated in accordance with Example 1 exhibited very slight static cling and slight static noise.

EXAMPLE 6

The quaternary content of Example 3 was reduced to 0.25% and fabric treated in accordance with the procedure of Example 1 exhibited slight static cling and moderate static noise.

Under these conditions, as little as 0.25% quaternary reduces static significantly.

EXAMPLE 7

$CaCl_2.2H_2O$ was substituted for the anhydrous $CaCl_2$ of Example 1 and fabrics treated therewith exhibited no static cling and slight static noise after the first wash and no static cling as well as no static noise after the second wash. Thus, it is apparent that both the hydrated and anhydrous salts are substantially equally effective in reducing static.

EXAMPLE 8

Anhydrous $CaSO_4$ was substituted for the $CaCl_2$ of Example 1 with the following results:

| | Static Cling | Static Noise |
|---|---|---|
| Wash 1 | Slight | Moderate |
| Wash 2 | None | Very Slight |

EXAMPLE 9

The $CaSO_4$ content of Example 8 was increased to 1%. Fabrics treated herewith after the first wash exhibited no static cling and only slight static noise.

These results clearly show that the adverse effect on whiteness of 5% quaternary compounds is minimized, and a high level of static reduction is maintained by utilizing both 0.25–1% quaternary and 0.5–1% of a calcium or magnesium salt in a detergent composition. This is clearly unexpected as evidenced by substantially no static reduction with the magnesium or calcium salt alone, and substantially no static reduction with less than 2% quaternary compound. Thus it is apparent that the magnesium or calcium salt combined with the quaternary yields a synergistic effect not attainable by either compound per se.

Other quaternary softener compounds as aforedefined (including the imidazolinium type) may be substituted for the distearyl dimethyl ammonium chloride utilized in the specific examples with similarly superior anti-static properties. Similarly, other magnesium and/or calcium salts may be substituted for the specific salts used in the specific examples with the same beneficial results. The quaternary/magnesium and/or calcium salt ratios and the concentrations of said blend with various detergent formulations can be suitably varied to obtain optimum and/or desired cleaning, and anti-static effects.

While various preferred embodiments of the present invention have been illustrated by means of specific examples, it is to be understood that the present invention is in no way to be deemed as limited thereto, but should be construed as broadly as all or any equivalents thereof.

What is claimed is:

1. A laundry product which cleans and eliminates static electricity on synthetic fabrics comprising an organic detergent selected from the class consisting of anionic, non-ionic, amphoteric surfactants and mixtures thereof wherein the amount of anionic ranges from about 5–24%, the amount of nonionic from about 2–20% and the amount of amphoteric from about 2–20% and about 0.5 to 1% of a water-soluble organic or inorganic magnesium or calcium salt, and about 0.25 to 1% of a quaternary ammonium compound, all percents by weight of the total composition.

2. The composition of claim 1 which also contains one or more water soluble builder salts.

3. The composition of claim 1, wherein the quaternary compound is dimethyl distearyl ammonium chloride.

4. The composition of claim 1, wherein the salt is calcium chloride.

5. The composition of claim 1 wherein the salt is magnesium sulfate.

6. A method of simultaneously cleaning and eliminating the static on synthetic fabrics which comprises applying to said fabrics in an aqueous bath, an amount of the composition of claim 1 sufficient to clean and eliminate the static properties of fabrics.

7. The method of claim 6, wherein the composition of claim 1 is added to the wash cycle during laundering.

8. A method of simultaneously washing and eliminating the static on synthetic fabrics which comprises laundering said fabrics with the composition of claim 2.

* * * * *